US006294970B1

(12) United States Patent
Pitschi et al.

(10) Patent No.: US 6,294,970 B1
(45) Date of Patent: Sep. 25, 2001

(54) BANDPASS FILTER

(75) Inventors: Franz Pitschi, Rottach-Egern; Manfred Lang, Taufkirchen; Werner Appel, München; Hans Pinzel, Bruckmühl, all of (DE)

(73) Assignee: Spinner GmbH Elektrotechnische Fabrik, München (DE)

( * ) Notice: Subject to any disclaimer, the term of this patent is extended or adjusted under 35 U.S.C. 154(b) by 0 days.

(21) Appl. No.: 09/210,495

(22) Filed: Dec. 11, 1998

(30) Foreign Application Priority Data

Dec. 16, 1997 (DE) ..... 197 55 744
Jul. 21, 1998 (DE) ..... 198 32 804

(51) Int. Cl.[7] ..... H01P 1/20; H01P 1/205
(52) U.S. Cl. ..... 333/212; 333/202; 333/209; 333/232
(58) Field of Search ..... 333/227, 230, 333/231, 208, 209, 212

(56) References Cited

U.S. PATENT DOCUMENTS 4,028,651 * 6/1977 Leetma ..... 333/212
4,513,264 * 4/1985 Dorey et al. ..... 333/209 X
4,578,658 * 3/1986 Urien et al. ..... 333/227
5,841,330 * 11/1998 Wenzel et al. ..... 333/202
5,969,585 * 10/1999 Nishiyama et al. ..... 333/202

* cited by examiner

*Primary Examiner*—Robert Pascal
*Assistant Examiner*—Stephen E. Jones
(74) *Attorney, Agent, or Firm*—Henry M. Feiereisen

(57) ABSTRACT

A bandpass filter, includes a series of waveguide resonators positioned along a common longitudinal axis so as to define at least a first resonator and a last resonator, whereby adjacent resonators are mechanically linked to one another by a common coupling plate of sheet metal member which is formed with coupling slots for electrically coupling the resonators, with the first and last resonators each being closed by an end plate of sheet metal. Each resonator is formed from a longitudinally welded sheet metal, and the end plates and the common coupling plate are each formed with circumferentially spaced tabs which are bent so as to extend along the adjoining waveguide, whereby the tabs are welded to the waveguide, and the joints between the end plates and the common coupling plate, on the one hand, and the adjacent waveguides, on the other hand, are soldered

14 Claims, 4 Drawing Sheets

Fig.1
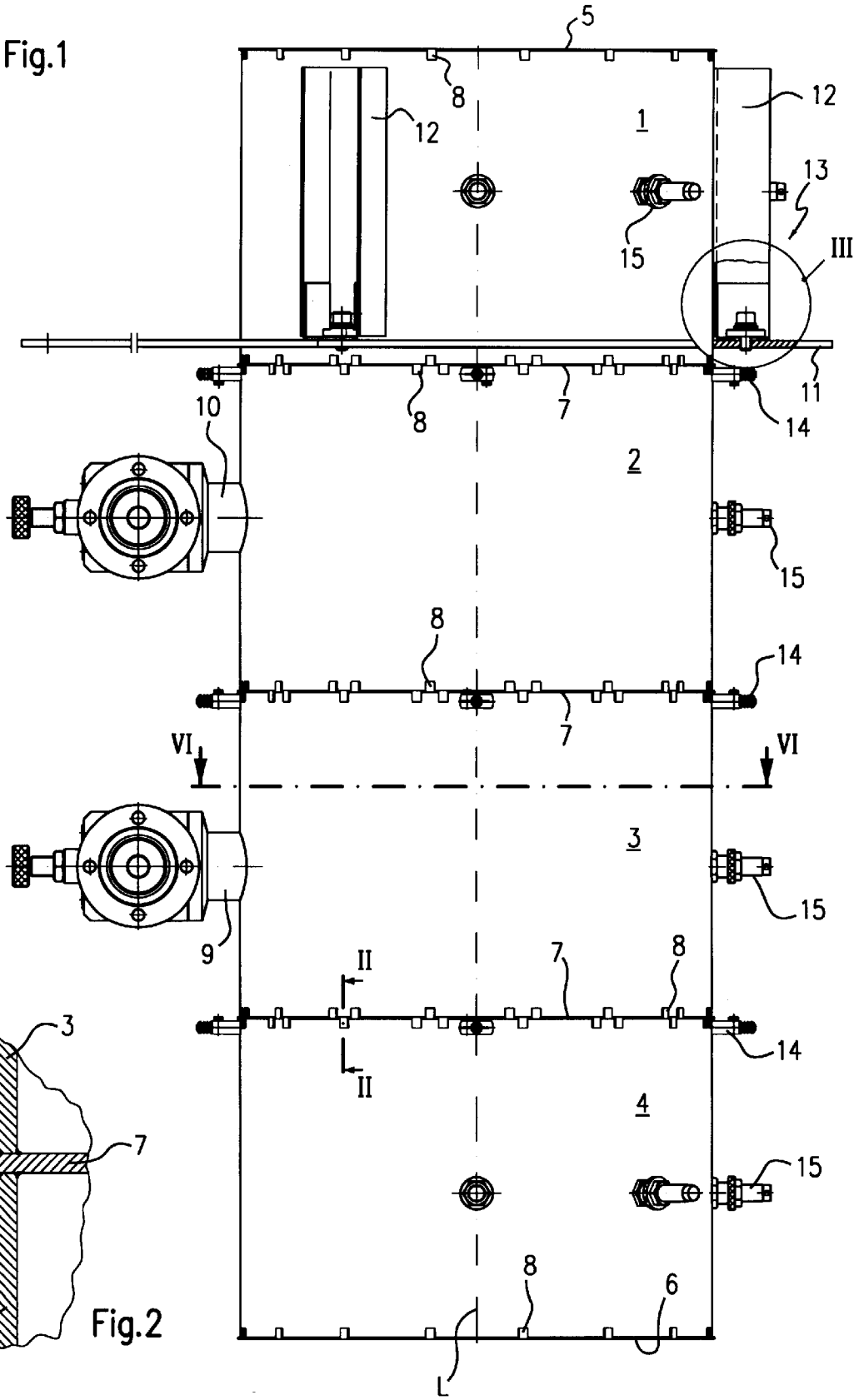
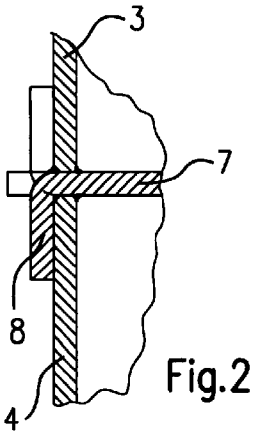
Fig.2

BANDPASS FILTER

CROSS-REFERENCES TO RELATED APPLICATIONS

This application claims the priorities of German Patent Applications, Ser. Nos. 197 55 744.9, filed Dec. 16, 1998, and 198 32 804.4, filed Jul. 21, 1998, the subject matters of which are incorporated herein by reference.

BACKGROUND OF THE INVENTION

The present invention relates in general to a bandpass filter, and more particularly to a multi-resonator bandpass filter of a type having a series of waveguide resonators positioned along a common longitudinal axis so as to define at least a first resonator and a last resonator, with adjacent resonators being mechanically linked to one another by a common coupling plate of sheet metal which is formed with coupling slots for electrically connecting the resonators, wherein the first resonator and the last resonator are closed by end plates of sheet metal.

Bandpass filters of this type are generally known. They have the drawback that the connection and closure of the individual waveguides require complicated and expensive flange structures. This is especially disadvantageous when considering that these bandpass filters are used in (digital) televisions operating in normal TV bands (f<1 GHz), and thus are very bulky.

SUMMARY OF THE INVENTION

It is thus an object of the present invention to provide an improved bandpass filter, obviating the afore-stated drawbacks.

In particular, it is an object of the present invention to provide an improved multi-resonator bandpass filter in which the resonators are connected to one another by a more cost-efficient construction compared to conventional designs.

These objects, and others which will become apparent hereinafter, are attained in accordance with the present invention by providing a series of waveguide resonators formed from a longitudinally welded sheet metal and positioned along a common longitudinal axis, thereby defining opposite axial ends, with one end being closed by a first end plate of sheet metal and the other end being closed by a second end plate of sheet metal, wherein the first and second end plates and the common coupling plates between adjacent resonators are each formed with circumferentially spaced tabs which are bent so as to extend along the adjoining waveguide resonator, with the tabs being welded to the waveguide resonators, and with the joints between the first and second end plates and the common coupling plate, on the one hand, and the adjacent waveguide resonators, on the other hand, being soldered.

A bandpass filter according to the present invention can be manufactured in a cost-efficient manner while still being stable and exhibiting a low transition resistance between the individual waveguide resonators. The high stability is realized by welding the coupling plates between adjacent waveguide resonators and the end plates onto the respective waveguide resonators. The low transition resistance between individual waveguide resonators and the sheet metal plates (end plates and coupling plates) which extend transversely to the center axis of the filter is realized by soldering the joints between the plates and the respective waveguide resonators. Thus, the use of expensive flanges is eliminated.

The same advantages are realized also for a dual mode bandpass filter which has only one resonator closed on opposite ends by two end plates but lacks the need for a coupling plate.

This technique is applicable in bandpass filters with waveguide resonators of random cross section, and can also be applied in bandpass filters with coaxial resonators.

According to another feature of the present invention, one of the waveguide resonators is formed with an input coupling terminal and another one of the waveguide resonators is formed with an output coupling terminal, whereby the input coupling and output coupling terminals are welded, preferably spot-welded, to the pertaining waveguide resonators, with the joints being soldered. In this manner, a cost-efficient and yet stable connection is effected.

Preferably, the common mechanical longitudinal axis of the resonators extends substantially vertical.

According to still another feature of the present invention, the filter can be so attached to a filter carrier that in a first mode of attachment the filter is securely fixed to the filter carrier, and in a second mode of attachment the filter is floatingly mounted to the filter carrier. In vertical alignment, the filter is subject to least tensions so that undesired deformations and detuning of the filter are prevented. This is further compounded by the floating mount of the filter to the filter carrier during operation. The floating mount of the filter substantially eliminates a possibility for deformation of the filter as a consequence of varying dilatations of the support structure and the filter. If securely fixed to the filter carrier, the filter could be subject to mechanical stress and deformation, when acted upon by high HF power and thereby heated, so that the filter and the support structure undergo different thermal expansion, ultimately resulting in a detuning of the filter. The fixed connection of the filter to the filter carrier is preferred, however, when transporting the filter.

Preferably, the filter is statically defined in connection with the filter carrier, whereby e.g. the waveguide of one of the resonators is formed about its circumference with spaced brackets, with each of the brackets being defined by a horizontal leg which is formed with a bore and so connectable to the filter carrier by a screw fastener that the screw fastener traverses a spacer. The spacer is formed on both sides with a projection so that its disposition can be reversed or inverted, whereby one of the projections is so dimensioned as to partially engage the bore of the leg, and the other projection is so dimensioned as to fully engage the bore. In this manner, the attachment of the filter can be easily switched from the fixed mode of attachment for transport to the operative mode in which the filter is floatingly mounted, and vice versa.

According to another feature of the present invention, the attachment of the filter to the filter carrier further includes a plurality of profiled rails which are mounted externally onto the waveguide resonators in parallel relationship to the center axis thereof for attachment of the mounting brackets to the waveguide resonators, whereby the profiled rails and the mounting brackets are placed into one-to-one correspondence. In this manner, the deformation of the filter can be further minimized. Moreover, the fairly high rigidity of the end plates and the coupling plates shows then its full effect as bending forces transmitted via the profiled rails are absorbed.

A frequency alignment of the filter may be realized by arranging adjustment slides in the coupling slots of the coupling plate, with each of the adjustment slides being formed as a carriage which is guided in the associated coupling slot and supports a jumper which contacts opposing slot edges, and by arranging rods in one-to-one correspondence with the adjustment slides for adjustment of the adjustment slides from outside, whereby the rods extend radially in parallel relationship to a plane defined by the coupling plate. In the event the rods are made of metal, the required screening to the outside is effected by resilient contact sleeves which are connected by soldering to the resonator wall.

Preferably, at least the waveguide resonators, each coupling plate and the end plates are made of a material with small thermal coefficient of expansion, for example, invar.

BRIEF DESCRIPTION OF THE DRAWING

The above and other objects, features and advantages of the present invention will now be described in more detail with reference to the accompanying drawing, in which:

FIG. 1 is a side view of one embodiment of a bandpass filter according to the present invention;

FIG. 2 is a cutaway view of the bandpass filter, taken along the line II—II in FIG. 1;

DETAILED DESCRIPTION OF PREFERRED EMBODIMENTS

Figure 3:
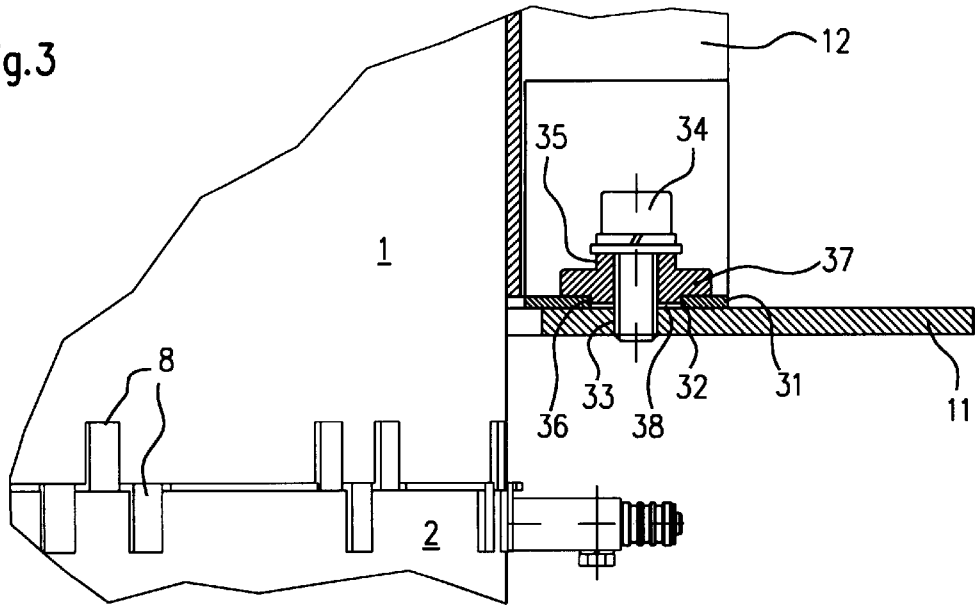
FIG. 3 is a cutaway, partially sectional view, on an enlarged scale, of the bandpass filter, showing a detail marked III in FIG. 1, with the filter occupying a transport mode.

Throughout all the Figures, same or corresponding elements are generally indicated by same reference numerals.

Figure 9:
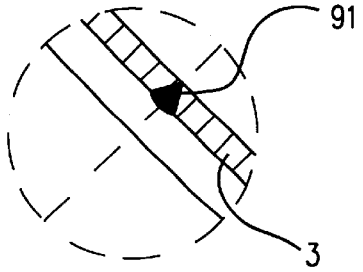
FIG. 9 is a cutaway, partially sectional view, on an enlarged scale, of the bandpass filter, showing a detail marked IX in FIG. 6.

Turning now to the drawing, and in particular to FIG. 1, there is shown a side view of one embodiment of a bandpass filter according to the present invention including a series of resonators in the form of circular waveguides or hollow conducting tubes, e.g. four resonators 1, 2, 3, 4. The resonators 1, 2, 3, 4 are positioned along a common mechanical longitudinal axis L which extends substantially vertical so that the filter is supported in a substantially stress-free fashion. Each waveguide of the resonators 1, 2, 3, 4 is made of rolled sheet metal which is welded longitudinally in parallel disposition to the center axis of the filter. FIG. 9 shows, by way of example, the longitudinal welding seam 91 of the waveguide 3. The uppermost resonator 1 is closed at the top by an end plate 5 of sheet metal while the lowermost resonator 4 is closed by an end plate 6 of sheet metal. The individual waveguides of the adjacent resonators 1, 2, 3, 4 are connected to one another by coupling plates 7 of sheet metal. The respective end plates 5, 6, and the coupling plates 7 are each formed with tabs 8 which are so bent as to be weldable onto the respective sheet metal of the adjoining waveguides to ensure a mechanical stability of the bandpass filter. The joints between the end plates 5, 6 and between the coupling plates 7, on the one hand, and the associated waveguide resonators 1, 2, 3, 4, on the other hand, are circumferentially soldered to assure a best possible contacting.

FIG. 2 shows a cutaway view of the bandpass filter, taken along the line II—II in FIG. 1 and illustrates, by way of example, the connection between the coupling plate 7 and the waveguide resonators 3 and 4, with reference to one exemplified tab 8 of the associated coupling plate 7. The tab 8 extends outwardly from the coupling plate 7 beyond the waveguide resonators 3, 4, and is so bent as to bear upon the circumference of the waveguide resonator 4. Subsequently, the tab 8 is welded on the waveguide resonator 4. As shown in FIG. 1, the tabs 8 formed on the coupling plates 7 are bent alternately in opposite directions so that one tab 8 is welded onto one waveguide and the next following tab 8 is bent in opposite direction for welding on the adjacent waveguide resonator (cf. FIG. 2). In the feedthrough area between adjacent waveguide resonators 3, 4, the coupling plate 7 is soldered, inside and outside, to the waveguide resonators 3, 4, as indicated in FIG. 2.

At a suitable location of its outer surface area, the waveguide 3 is formed with an input coupling terminal 9, while an output coupling terminal 10 is positioned on the outer surface area of the waveguide 10. The terminals 9, 10 are spot-welded to the associated waveguide resonators 3, 2, while the joints are soldered about the circumference.

Figure 6:
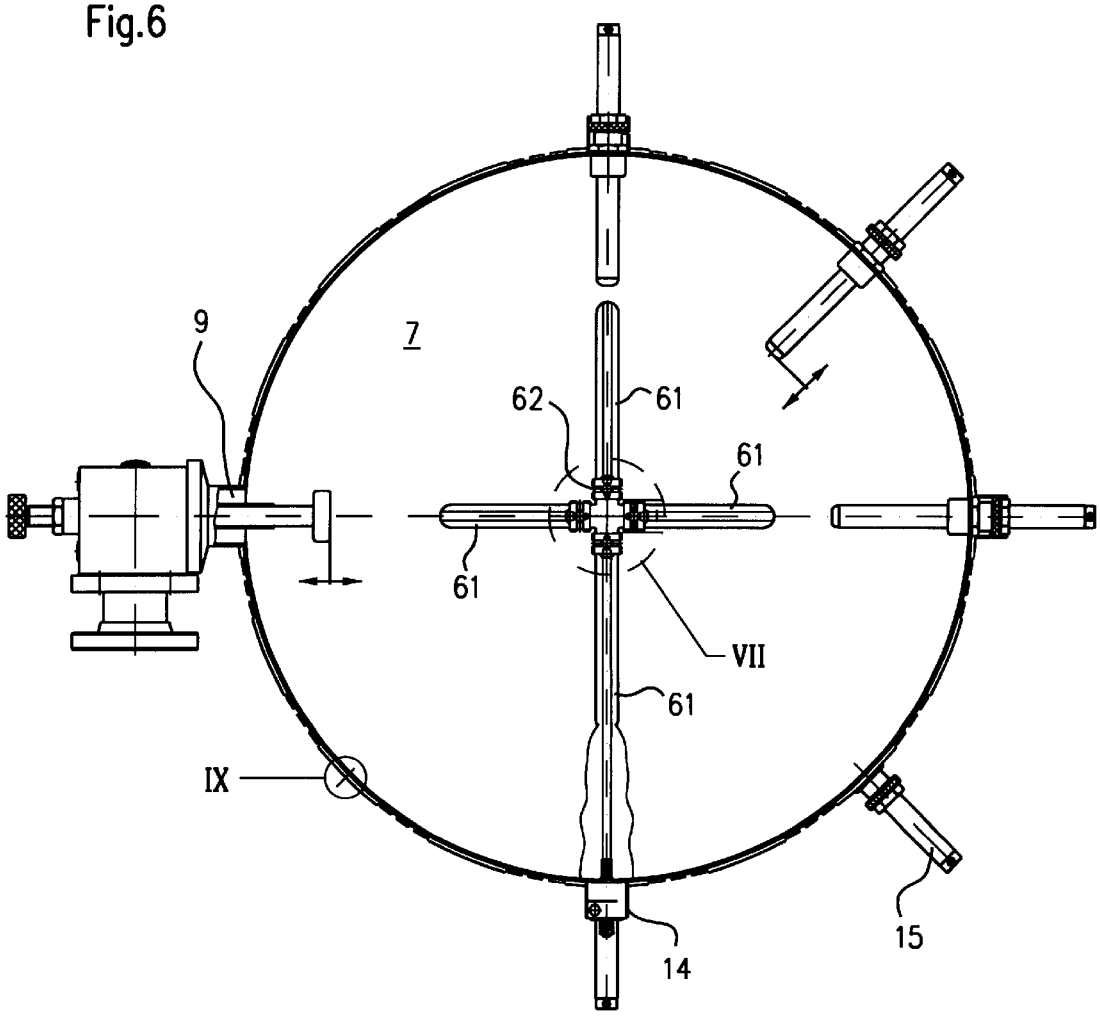
FIG. 6 is a sectional view of the bandpass filter, taken along the line VI—VI in FIG. 1.

As further shown in FIG. 1, and in particular in FIG. 6, compensation elements, for example adjusting screws 15, are positioned on the circumference of the individual waveguide resonators 1, 2, 3, 4.

Figure 5:
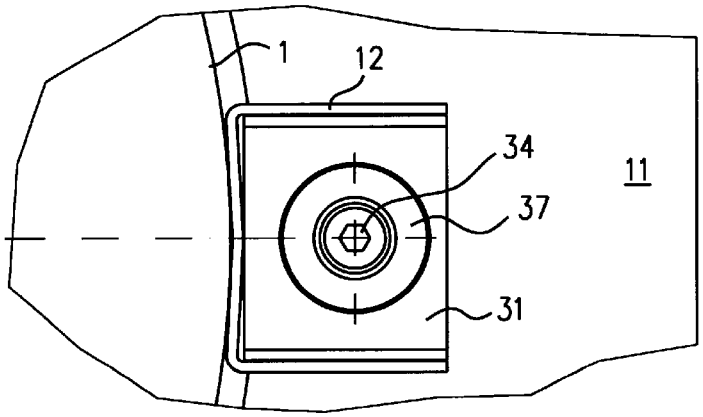
FIG. 5 is a fragmentary top plan view of the bandpass filter, showing the mounting structure for the filter as illustrated in FIGS. 3 and 4.

The bandpass filter is suspended in an opening of a mounting plate 11 via a mounting construction, generally designated by reference numeral 13 and interacting with the waveguide resonator 1. The mounting construction 13 includes profiled rails 12 for transmitting possibly encountered bending moments and stress substantially into the end plate 5 of the waveguide 1 and into the coupling plate 7 between adjacent waveguide resonators 1, 2. As shown in FIG. 5, the profile rails 12 have a substantially U-shaped configuration.

Turning now to FIG. 3, there is shown a cutaway, partially sectional view, on an enlarged scale, of the bandpass filter, showing a detail marked III in FIG. 1 to illustrate the mounting construction 13 for suspending the bandpass filter in the opening of the mounting plate 11. Connected to the profiled rail 12 is a bracket 31 which is formed with a bore 31. The bore 31 is defined by a center axis which coincides with the center axis of a bore 33 of the mounting plate 11. A screw fastener 34 traverses the bore 32 and engages in a thread of the bore 33, whereby a spacer 37 is positioned between the screw fastener 34 and the bracket 31. The spacer 37 has a generally cross-shaped configuration, and is formed on opposite sides thereof with projections 35, 36 which fit in the bore 32 of the bracket 31, depending on the selected position of the spacer 37. The projection 35 extending out from the bottom side of the spacer 37 has greater dimensions than the projection 36 extending out from the top side of the spacer 37.

FIG. 3 shows the bandpass filter according to the present invention in the idle position in which transport of the filter is possible. The spacer 37 of the mounting construction 13 is so placed with respect to the bracket 31 that the projection 36 of smaller dimension is received in the bore 32 so that a gap 38 is formed between the projection 36 and the mounting plate 11. Thus, the bracket 31 and thus the bandpass filter are securely clamped between the spacer 37 and the mounting plate 11, when the screw fastener 34 is tightened. The spacer 37 thus occupies the transport mode.

Figure 4:
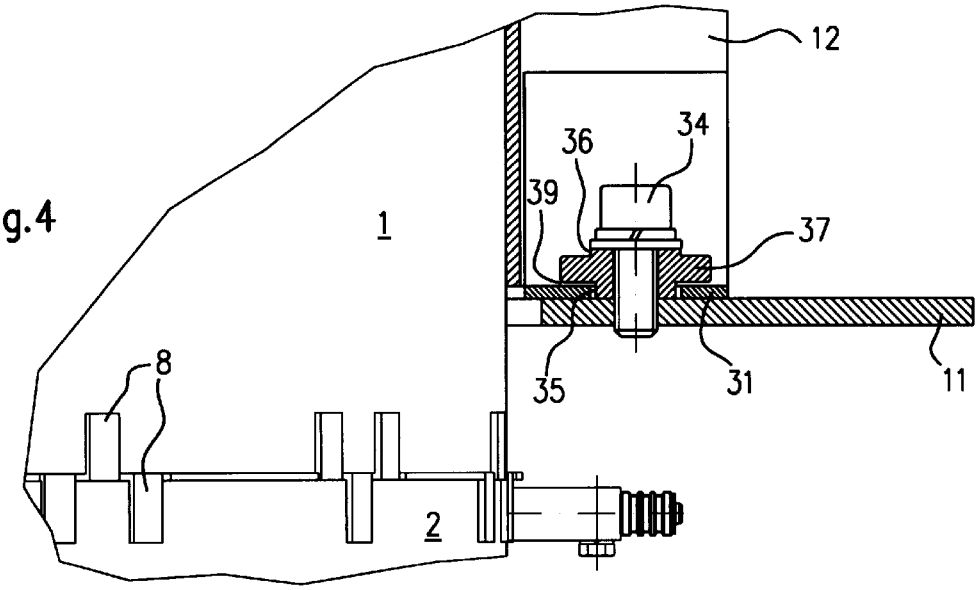
FIG. 4 is a partially sectional view of the bandpass filter similar to FIG. 3, with the filter floatingly mounted and occupying the operative mode.

FIG. 4 shows the bandpass filter according to the present invention in the operative position in which the filter is floatingly suspended in the mounting plate 11, by inverting the position of the spacer 37 so that the projection 35 of greater dimension is now received in the bore 32 to fully traverse the bore 32. Thus, a small gap 39 is formed between the spacer 37 and the bracket 31 to thereby floatingly connect the bandpass filter with the mounting plate 11. This configuration assures that the filter is suspended stress-free despite possible different, e.g. temperature-based dilatations of waveguides and mounting plate 11.

Figure 7:
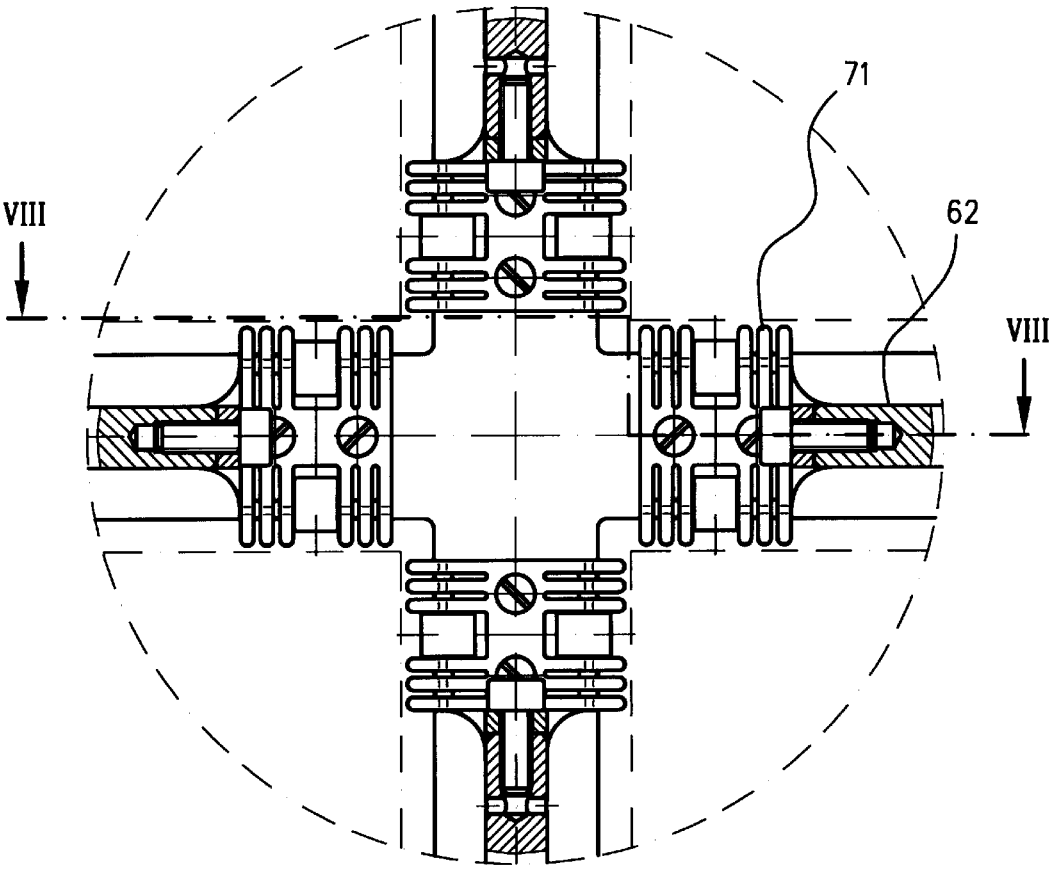
FIG. 7 is a cutaway, partially sectional view, on an enlarged scale, of the bandpass filter, showing a detail marked VII in FIG. 6.
Figure 8:
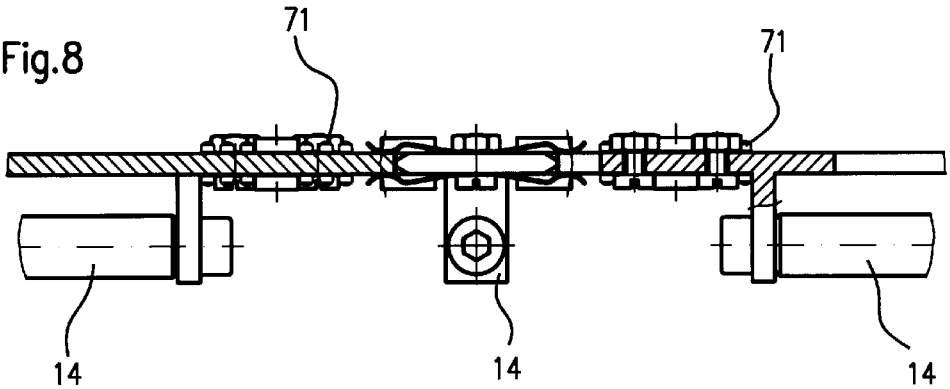
FIG. 8 is a partially sectional view of the bandpass filter, taken along the line VIII—VIII in FIG. 7.

Turning now again to FIG. 6, there is shown a sectional view of the bandpass filter, taken along the line VI—VI in FIG. 1. As can be seen therefrom, the coupling plate 7 is formed with four coupling slots 61 in crosswise configuration. As shown in greater detail in FIG. 7, each coupling slot 61 accommodates an adjustment slide 62 which can be shifted by appropriate adjustment members (FIGS. 1 and 8) to realize a frequency tuning. Each adjustment slide 62 carries a jumper 71 for contacting opposite slot edges.

While the invention has been illustrated and described as embodied in a bandpass filter, it is not intended to be limited to the details shown since various modifications and structural changes may be made without departing in any way from the spirit of the present invention.

What is claimed is:

1. A bandpass filter, comprising:

a series of waveguide resonators positioned along a common mechanical longitudinal axis, thereby defining at least a first resonator and a last resonator, with adjacent resonators being mechanically linked to one another by a common coupling plate of sheet metal which is formed with coupling slots for electrically coupling the resonators, said first resonator being closed by a first end plate of sheet metal and said last resonator being closed by a second end plate of sheet metal, each of said resonators being formed from longitudinally welded sheet metal, wherein the first and second end plates and the common coupling plate are each formed with circumferentially spaced tabs which are bent so as to extend along the adjoining waveguide resonator, wherein the tabs are welded to the waveguide resonators, and wherein the first and second end plates and the common coupling plate are soldered to the adjacent waveguide resonators at their joints.

2. The bandpass filter of claim 1 wherein one of the waveguide resonators is formed with an input coupling terminal and another one of the waveguide resonators is formed with an output coupling terminal, said input coupling terminal and said output coupling terminal being welded to the waveguide resonators, and soldered at their joints.

3. The bandpass filter of claim 2 wherein the input coupling terminal and the output coupling terminal are spot-welded to the waveguide resonators.

4. The bandpass filter of claim 1 wherein the longitudinal axis extends substantially vertical, and further comprising a filter carrier for support of the filter, and fastening means for so securing the filter to the filter carrier so that in a first mode of attachment the filter is securely fixed to the filter carrier, and in a second mode of attachment the filter is floatingly secured to the filter carrier.

5. The bandpass filter of claim 4 wherein each of the waveguide resonators is formed about its circumference with spaced mounting brackets, with each of the mounting brackets having a horizontal leg which is formed with a bore, said fastening means including a positionally invertable spacer and a screw fastener traversing the spacer for securing the leg of the mounting bracket to the filter carrier, said spacer having opposite sides and formed with two projections, with one of the projections extending out from one of the opposite sides and so dimensioned as to partially engage the bore of the leg, and with the other one of the projections extending out from the other one of the opposite sides and so dimensioned as to fully engage the bore.

6. The bandpass filter of claim 5 wherein the fastening means includes a plurality of profiled rails mounted externally onto the waveguides of the resonators in parallel relationship to a center axis of the resonators for attachment of the mounting brackets to the waveguide resonators, whereby the profiled rails and the mounting brackets are placed into one-to-one correspondence.

7. The bandpass filter of claim 1, and further comprising a plurality of adjustment slides, each of the adjustment slides being disposed in a corresponding one of the coupling slots of the coupling plate, whereby the adjustment slides and the coupling slots are placed into one-to-one correspondence, each of the adjustment slides being formed as a carriage which is guided in the associated coupling slot and supports a jumper which contacts opposing slot edges, and further comprising a plurality of rods in one-to-one correspondence with the adjustment slides, said rods extending radially in parallel relationship to a plane defined by the coupling plate for actuating the adjustment slides from outside.

8. The bandpass filter of claim 1 wherein the waveguide resonators, the coupling plate and the end plates are made of a material with small thermal coefficient of expansion.

9. A multi-resonator bandpass filter, comprising:

at least two waveguide resonators formed from longitudinally welded sheet metal and positioned along a longitudinal axis in end-to-end disposition, thereby defining opposite axial ends, said resonators being mechanically linked to one another by a common coupling plate of sheet metal which is placed between the resonators and formed with coupling slots for electrically coupling the resonators, with one axial end closed by a first end plate of sheet metal, and the other axial end closed by a second end plate, wherein the first and second end plates and the coupling plate are each formed with outwardly extending circumferentially spaced tabs which are bent so as to extend externally on the associated resonator, said tabs being welded to the resonators, and said first and second end plates and the coupling plate are soldered to the resonators at their interfaces.

10. The band pass filter of claim 9, and further comprising fastening means for so securing one of the resonators to a mounting plate so that in a first mode of attachment the filter is securely fixed to the filter carrier, and in a second mode of attachment the filter i s floatingly secured to the filter carrier.

11. The bandpass filter of claim 10 wherein the fastening means includes a profile rail secured externally to the one resonator, a bracket fixed to the profile rail and extending substantially parallel to the mounting plate, a spacer, and a screw fastener for securing the bracket to the mounting plate, with the spacer being interposed between the screw fastener and the bracket, said spacer having opposite sides, each side being formed with a projection for engagement in a bore of the bracket whereby the projections have different dimensions, said spacer being positioned in the first mode of attachment with the projection of smaller dimension in registry with the bore, thereby defining a gap between the bracket and the mounting plate, and said spacer being positioned in the second mode of attachment with the projection of greater dimension in registry with the bore, thereby defining a gap between the spacer and the bracket.

12. The bandpass filter of claim 9, and further comprising fastening means for so securing the resonator to a mounting plate so that in a first mode of attachment the filter is securely fixed to the filter carrier, and in a second mode of attachment the filter is floatingly secured to the filter carrier.

13. The bandpass filter of claim 12 wherein the fastening means includes a profile rail secured externally to the resonator, a bracket fixed to the profile rail and extending substantially parallel to the mounting plate, a spacer, and a screw fastener for securing the bracket to the mounting plate, with the spacer being interposed between the screw fastener and the bracket, said spacer having opposite sides, each side being formed with a projection for engagement in a bore of the bracket whereby the projections have different dimensions, said spacer being positioned in the first mode of attachment with the projection of smaller dimension in registry with the bore, thereby defining a gap between the bracket and the mounting plate, and said spacer being positioned in the second mode of attachment with the projection of greater dimension in registry with the bore, thereby defining a gap between the spacer and the bracket.

14. A dual mode bandpass filter, comprising a waveguide resonator formed from longitudinally welded sheet metal and having opposite axial ends respectively closed by an end plate of sheet metal, each of the end plates being formed with outwardly extending circumferentially spaced tabs which are bent so as to extend externally on the resonator, said tabs being welded to the resonator, and said end plates being soldered to the resonator at their interfaces.

* * * * *